United States Patent [19]

Smithers

[11] Patent Number: 4,463,855

[45] Date of Patent: Aug. 7, 1984

[54] PLANT HANGER FRAME

[76] Inventor: James F. Smithers, 63 Varnum St., Haverhill, Mass. 01838

[21] Appl. No.: 316,883

[22] Filed: Oct. 30, 1981

[51] Int. Cl.[3] ..... A47F 5/08; A47F 5/13

[52] U.S. Cl. ..... 211/71; 47/40; 211/87; 211/118; 248/323; 248/333

[58] Field of Search ..... 211/71, 85, 87, 88, 211/113, 118; 47/40; 248/323, 333, 318

[56] References Cited

U.S. PATENT DOCUMENTS

| | | | |
|---|---|---|---|
| 1,118,157 | 11/1914 | Shine | 211/87 |
| 1,260,235 | 3/1918 | Menzl | 211/118 X |
| 1,391,599 | 9/1921 | Wood | 211/87 |
| 1,989,292 | 1/1935 | Serpico | 211/81 X |
| 3,138,359 | 6/1964 | Stewart | 211/87 X |
| 3,978,612 | 9/1976 | Young | 47/40 |
| 4,068,761 | 1/1978 | McCarthy | 47/40 X |
| 4,188,871 | 2/1980 | Boyajian | 211/88 X |

*Primary Examiner*—Ramon S. Britts
*Assistant Examiner*—Robert W. Gibson, Jr.

[57] ABSTRACT

A trapezoidal framework for suspending houseplants in front of a window pane. The framework attaches to a window frame and has diagonal members equipped with hooks for supporting pots on straps or wires. The diagonal members are pivotally interconnected and telescopically adjustable, so that the framework can be made to fit a variety of window sizes. Brackets securing the framework to the window frame will accommodate window frames of either rectangular or rounded-off cross-sections. The framework will not interfere with opening and closing of the window or with placement of curtains and draperies.

5 Claims, 5 Drawing Figures

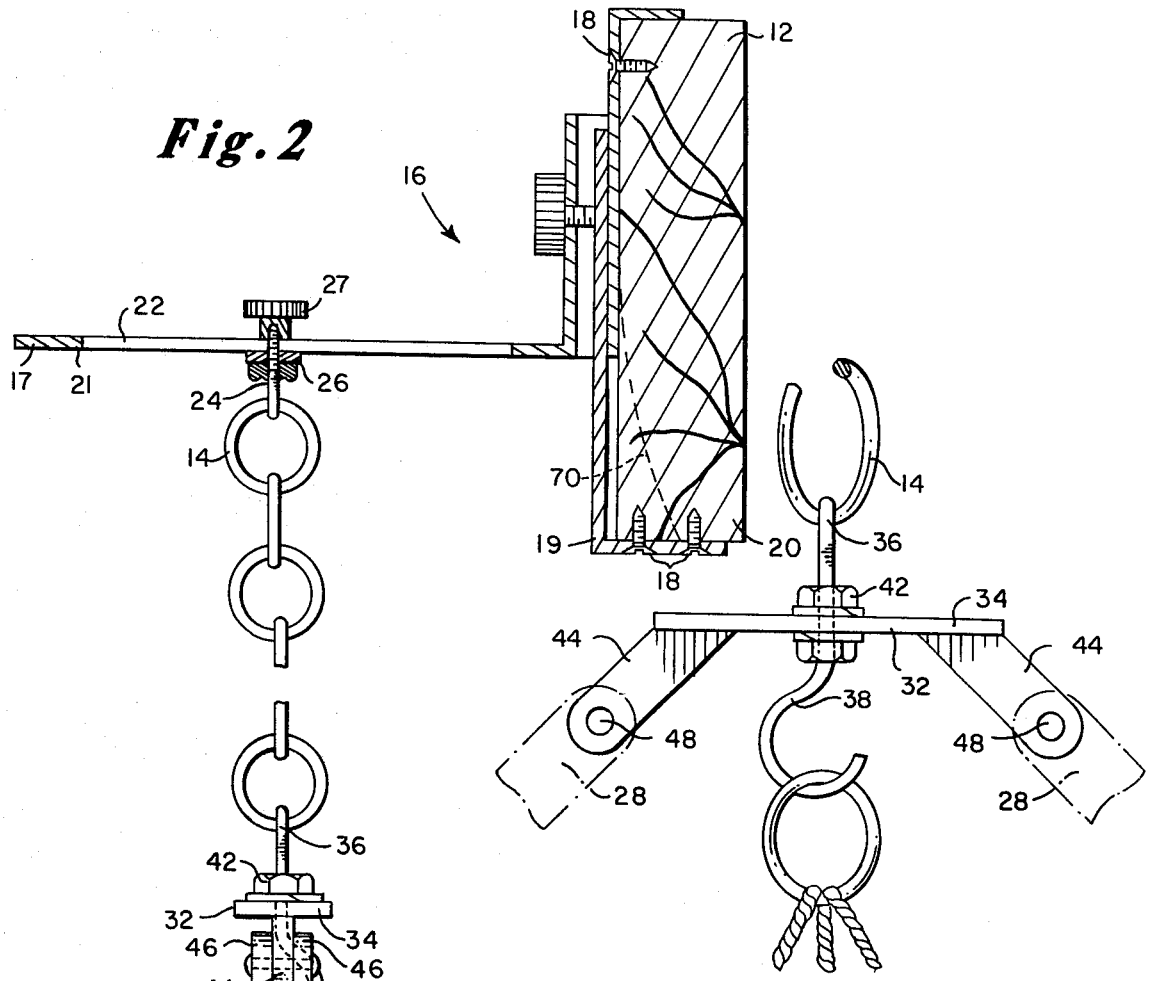
Fig. 2
Fig. 4
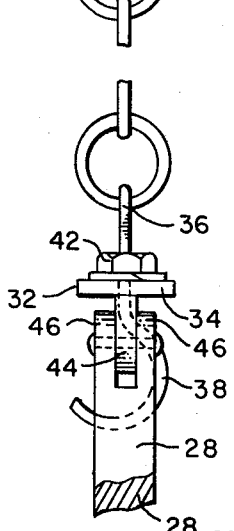
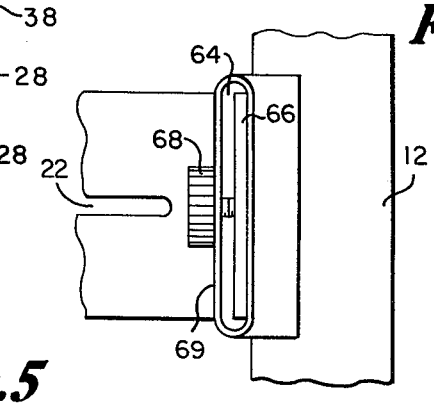
Fig. 5
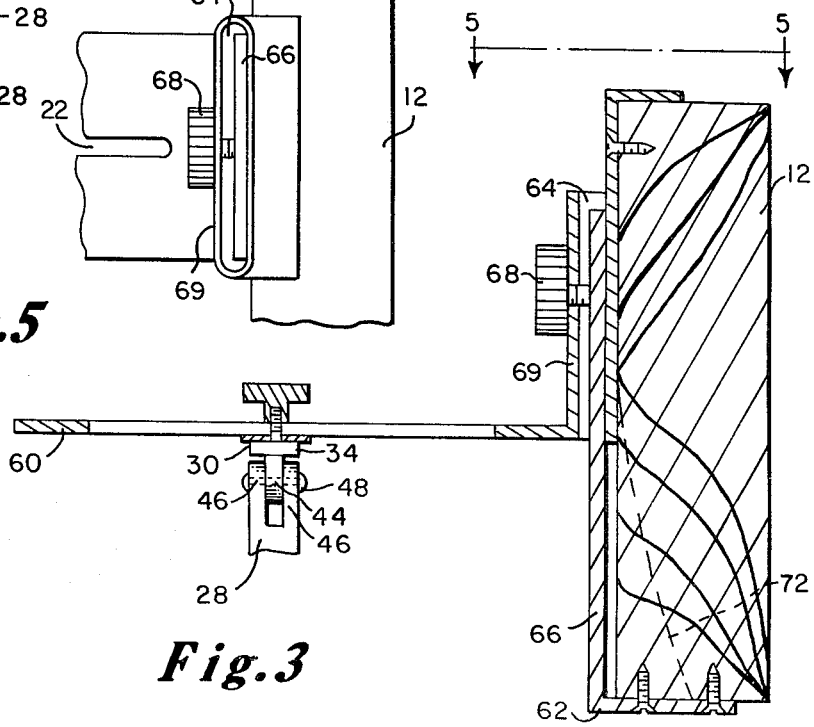
Fig. 3

PLANT HANGER FRAME

CROSS-REFERENCES TO RELATED APPLICATION(S)

This application is an expansion of Disclosure Document No. 099,762, filed Apr. 8, 1981.

BACKGROUND OF THE INVENTION

1. Field of the Invention

The present invention relates generally to devices for suspending plants in sunlet areas, and more specifically to frames adapted to be attached to the inside of window frames for suspending potted houseplants adjacent to the glass pane.

2. Description of the Prior Art

A number of plant holders are known in the art. U.S. Pat. No. 172,011 discloses a horizontal rail permanently secured to each side of the window frame and having sliding pot supports disposed thereon. U.S. Pat. No. 328,926 discloses a set of rings for supporting frustoconical pots in a cantilevered position in front of the window sill. U.S. Pat. No. 342,476 discloses a vertical pole supported by horizontal rods attached to brackets on the window frame and in turn supporting radial clusters of pot-supporting disks. U.S. Pat. No. 2,051,241 discloses a shelf suspended by hooks from the top rail of the lower window sash. U.S. Pat. No. 3,007,582 discloses screw-extensible vertical poles, with extending pegs, for car windows. U.S. Pat. No. 3,978,612 discloses a bracket affixed to the top rail of the lower window sash and pivotally supporting rod members terminating in hooks. U.S. Pat. No. 4,068,761 discloses a vertical spring-loaded pole which stands on the window sill and provides projecting pegs for supporting plants. However, most conventional plant holders suffer from the defect that they interfere with the opening and closing of the window or with the placement of curtains and draperies. Many of them also do not adapt to different sizes of windows.

SUMMARY OF THE INVENTION

Accordingly, a primary object of the present invention is a framework for supporting plants which does not interfere with normal operation of the window and placement of curtains. Another object of the invention is to make a plant holder which adjusts to fit windows of different sizes. A further object of the invention is to provide a plant holder which collapses into a small space for storage or transport. Yet another object of the invention is to provide plant holders which can be connected together in series to accomodate double or triple windows.

To accomplish these and other objects, the present invention has among its many features a trapezoidal array of telescoping diagonal members pivotally connected together. The top corner of the trapezoid is suspended by a chain from an L-shaped bracket attached to the vertical face of the top of the window frame. The left and right corners of the trapezoid are secured to brackets screwed into the outside vertical face of the window frame which is perpendicular to the plane of the wall surrounding the window. The top and bottom corners of the trapezoid are each provided with a depending hook for supporting a flowerpot on straps or wires.

Each diagonal member comprises a central section and two end sections. Each central section is provided with a depending hook or ring for supporting another flowerpot. Thus, the framework is capable of supporting at least six different plants in a stepped configuration, or more, depending upon the number of hooks placed in each diagonal member.

The end sections of the diagonal members are adapted to telescope with the middle sections, so that the trapezoid will fit wider or narrower windows. In addition, since the diagonal members are pivotally interconnected, the height/width proportions of the trapezoid can be varied for proper fit. The vertical placement of the trapezoid in relation to the window frame can be varied by choosing a longer or shorter chain between the top mounting bracket and the top corner of the trapezoid.

BRIEF FIGURE DESCRIPTION

These and other objects, features and advantages of the invention will appear from the following description of a preferred embodiment, as shown in the attached drawings, in which:

FIG. 2 is an enlarged, cross-sectional view taken along the line 2—2 of FIG. 1;

FIG. 3 is an enlarged cross section taken along the line 3—3 of FIG. 1;

FIG. 4 is a cross-sectional view of a tapered window frame and side mounting brackets attached thereto; and FIG. 5 is an end view of a side mounting bracket, taken along line 5—5 of FIG. 4.

DETAILED DESCRIPTION OF THE PREFERRED EMBODIMENT

Figure 1:
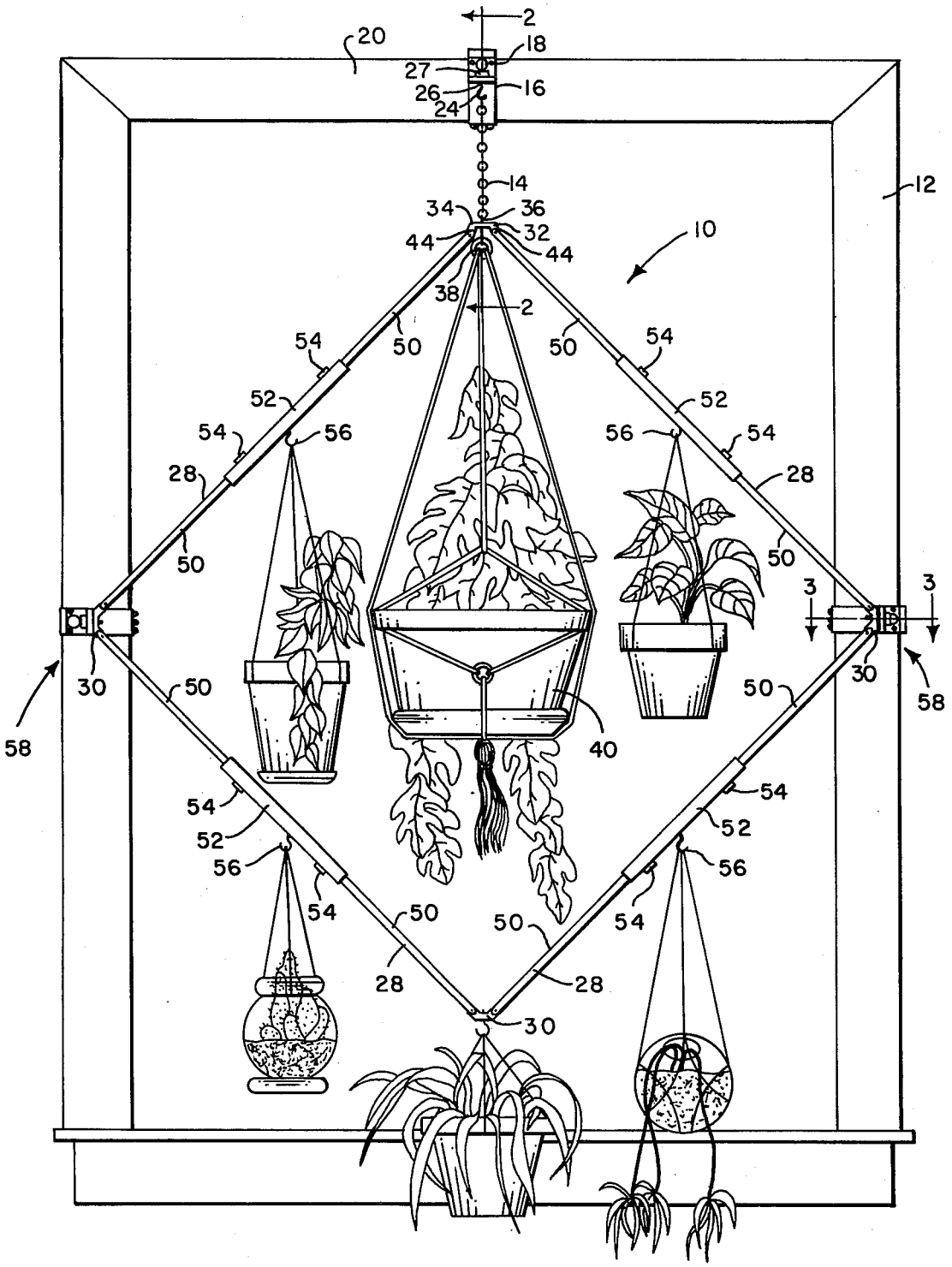
FIG. 1 is a front view of the framework and brackets of the present invention, mounted on a window frame.

FIG. 1 illustrates a plant hanger framework 10 mounted on a conventional rectangular window frame 12, which may surround either a fixed pane of glass or movable upper and lower sashes (not shown). The framework 10 is preferably trapezoidal or diamond-shaped and is suspended by a chain 14 from a top mounting bracket 16. In its preferred form the framework is square.

As shown in FIG. 2, bracket 16 comprises two L-shaped angle members 17, 19 with screws 18 extending through their short legs for securing them to top plank 20 of window frame 12. As detailed in FIG. 5, there is a longitudinal slot 22 along the length of horizontal long leg 21 of member 17. A hook 24, having threads along its straight portion, is held vertically in slot 22 by a pair of nuts 26, 27 having diameters greater than the width of slot 22, which are tightened adjacent the upper and lower surfaces of bracket 16 on the threads of the hook 24 until they fasten the hook immovably in the bracket 16. By temporarily loosening either or both nuts 26, 27, the hook 24 can be moved toward or away from window frame 12 to place the framework 10 in the desired position.

As shown generally in FIG. 1, the trapezoidal framework 10 comprises four diagonal members 28, pivotally interconnected by ear brackets 30. As shown in FIG. 4, topmost ear bracket 32 includes a horizontal planar surface 34 pierced by a hook 36 projecting vertically upward and a hook 38 projecting vertically downward. Upward hook 36 fits through and is preferably crimped around the bottom-most link of chain 14 to support the framework 10 on the top mounting bracket 16. Downward hook 38 is adapted to receive straps or wires from a hanging flowerpot 40 or the like. The hooks 36 and 38 may be secured to the ear bracket 32 by a pair 42 of nuts and lock washers.

Ear bracket 32, in addition to the planar section 34, further comprises depending left and right ears 44. These ears are preferably integrally formed with planar section 34 and project to the left and right of downward hook 38, either with their axes perpendicular to section 34 and parallel to hook 38, or at an angle to hook 38 of between 90° and 150°. These ears 44 are preferably of lesser thickness front to back than planar section 34 and are provided with holes front to back at their lower extremities.

Each diagonal member 28 is forked at each end, with the tines 46 of the forked end adapted to be pivotally secured to one of the ears 44 by a rivet 48 passing through both tines 46 and the ear disposed between the tines. The combined thickness of the ear 44 and the tines 46 approximates the thickness of planar section 34.

Each of the other ear brackets 30, at the left, right and bottom corners of the framework 10, has a configuration similar to that of topmost bracket 32, except that the left and right brackets have no attached hooks, while the bottom bracket has only a downwardly projecting hook.

Each diagonal member 28 includes two end sections 50 and a central section 52, so that adjustment of the length of the member 28 is possible by telescoping the sections together. Although the question of which section or sections should be hollow is a matter of choice, in the preferred embodiment central section 52 is hollow so that end sections 50 can be telescoped into it as far as desired. A set screw or knob 54 with a knurled edge radially penetrates each end of central section 52 and bears against the end section 50 inside to secure it in place.

Each central section 52 is also provided with at least one depending hook 56, preferably attached near the middle of the section's length, for receiving straps or wires from a hanging plant. If the diagonal members 28 are mounted at right angles to each other, the depending hooks 56 to be vertical should be disposed at a 45° angle to the diagonal member 28. Of course, for mounting on elongated rectangular window frames, it may be desirable to mount the framework 10 so that the upper diagonal members are at an acute angle with respect to each other and at an obtuse angle with respect to the lower members.

For installation on a single window, each left and right ear bracket 30 is bolted to a set of side mounting brackets 58. To allow for the different widths of the boards on each side of a window frame, each set 58 comprises a pair of angle members 60, 62 similar to top mounting bracket 16. As shown in FIGS. 3 and 5, a portion 69 of member 60 parallel to window frame 12 is provided with a longitudinal slot 64, so that members 60 and 62 can telescope together to allow for differences in window frame width. The short leg of each angle member 60, 62 is screwed to the side of the window frame, with the axes of the screws parallel to the window pane. The legs 64, 66 of the angle members 60, 62 are fastened together by a fastener 68 which screws through portion 69 into slot 64 and bears against leg 66 of angle member 62. This procedure guarantees that the long legs of the angle members will remain parallel to the window pane and the wall, even if the window frame is tapered thinner as it approaches the window pane, as shown by dashed lines 70 and 72 in FIGS. 2 and 3. For installation on double or triple windows, the brackets 30 of adjoining frameworks 10 can be fastened together for stability, forming a decorative lattice.

It will be appreciated that the depending hook on each of the top and bottom ear brackets and a single hook 56 on each of four diagonal members will allow the hanging of six plants on a single framework, which can be installed or removed with only a few screws. Since the diagonal members 28 telescope, the framework 10 will fit a number of different sizes of windows and can be moved by its owner from one dwelling to another. The pivotal interconnection of the diagonal members means that the framework will collapse into a single linear unit for transport or storage.

From the foregoing description, those skilled in the art will appreciate that numerous variations may be made of this invention without departing from its spirit. Therefore, I do not intend to limit the scope of this invention to the single embodiment shown and described. Rather, it is my intention that the scope of this invention be determined by the appended claims and their equivalents.

What is claimed is:

1. A plant hanger framework comprising four elongated members, means pivotally interconnecting said elongated members end to end to form a plurality of corners and a diamond trapezoid shape, means for hanging a plant from each elongated member, means for securing at least two corners of said framework to a window frame, and means for adjusting the length of each of said elongated members, said framework being adjustable to fit within the periphery of window frames of different sizes, a bracket means to suspend said framework from the top of a window frame, said bracket means including a bracket adapted to be secured to a window frame and means interconnecting said bracket with said elongated members.

2. A plant hanger as set forth in claim 1 including a plurality of hooks secured to said elongated members and adapted to have plants suspended from each.

3. A plant hanger as set forth in claim 2 wherein said elongated members each comprise a plurality of sections with means for telescoping said sections together whereby the length of said elongated members may be adjusted.

4. A plant hanger as set forth in claim 3 wherein adjacent ends of said elongated members are secured together by ear brackets, said ear brackets comprising a planar surface and a pair of ears extending therefrom, each of said ears of each ear bracket pivotally engaging the end of one of said elongated members.

5. A plant hanger framework as set forth in claim 4 further comprising a plurality of said hangers joined together at adjacent ear brackets by connecting means to form an enlarged framework whereby said framework may be used in association with an oversize window.

* * * * *